US005743395A

United States Patent [19]

Backer

[11] Patent Number: 5,743,395

[45] Date of Patent: Apr. 28, 1998

[54] SOCKET HOLDER

[76] Inventor: William E. Backer, One Industrial Rd., P.O. Box 128, Fulton, Mo. 65251

[21] Appl. No.: 769,952

[22] Filed: Dec. 19, 1996

[51] Int. Cl.[6] ..... B65D 85/24

[52] U.S. Cl. ..... 206/378; 206/372

[58] Field of Search ..... 206/376, 377, 206/378, 493, 486, 372, 373; 211/70.6

[56] References Cited

U.S. PATENT DOCUMENTS

| | | | |
|---|---|---|---|
| 337,860 | 7/1982 | Carrigan | 206/376 |
| D. 355,554 | 2/1995 | Phelps . | |
| 1,916,918 | 7/1933 | Carroll | 206/378 |
| 2,532,636 | 12/1950 | Minnich | 206/377 |
| 4,621,738 | 11/1986 | DeLucchi | 206/378 |
| 4,927,020 | 5/1990 | Randy . | |
| 5,050,733 | 9/1991 | Brennan . | |
| 5,328,029 | 7/1994 | Chow | 206/378 |
| 5,368,164 | 11/1994 | Bennett et al. | 206/376 |
| 5,407,063 | 4/1995 | Warner et al. | 206/378 |
| 5,570,784 | 11/1996 | Sidabras et al. | 206/378 |

*Primary Examiner*—Paul T. Sewell
*Assistant Examiner*—Luan K. Bui
*Attorney, Agent, or Firm*—Polster, Lieder, Woodruff & Lucchesi, LC

[57] ABSTRACT

A socket holder for a plurality of socket wrench sockets has studs projecting from a top surface, each of the studs being sized and shaped closely uniquely to engage a particular socket so that the socket on a stud will not be accidentally dislodged, and the stud can be used to measure a nut or the head of a bolt before the socket is employed. The studs are accompanied by indicia of size. Preferably, the indicia may be tactilely read.

2 Claims, 3 Drawing Sheets

SOCKET HOLDER

CROSS-REFERENCE TO RELATED APPLICATIONS

STATEMENT REGARDING FEDERALLY SPONSORED RESEARCH OR DEVELOPMENT

Not applicable.

BACKGROUND OF THE INVENTION

Socket wrenches are widely used by mechanics, repairmen, and do-it-yourselfers to loosen or tighten nuts and bolts. These wrenches have the advantage of being usable in confined areas such as recessed holes. They are also faster than other types of wrenches, and the shape of the socket reduces the chances of rounding a nut or bolt head. Socket wrenches consist of a six or twelve point socket that fits over the nut or bolt and a driving handle that snaps into the back of the socket. The socket is generally cylindrical, with a square recess at one end that receives a shank on the wrench handle, and a working end that mates with a fastener. A ratchet is the most commonly used driving device, although other types such as flex-heads, slide bars, and speeders are also used. For those applications that prevent the driving device from being attached directly to the socket, an extension bar is used. The extension bar snaps into the socket and onto the driving device.

The present invention is designed to provide a socket wrench user with a convenient way to store sockets and keep them sorted for quick, easy access and ready identification.

Numerous prior art socket holders provide for securement of a socket square end. For example, U.S. Pat. No. 5,284,245 issued to Slivon et al shows a portable socket holder with socket receiving clips proportioned to receive a socket square end; U.S. Pat. No. 5,050,733 issued to Brennan describes a socket wrench organizer assembly including dowel elements for retaining the socket square end; U.S. Pat. No. 4,927,020 issued to Randy shows a holder for socket wrench heads including a plurality of cross sectionally square posts for securement of the socket square recessed end; and U.S. Pat. No. 4,337,860 issued to Carrigan shows a detachable wrench set organizer and storage unit with a multiplicity of circularly cylindrical posts of various diameters to accommodate different ratchet drive sizes and wear or manufacturing variations to secure the socket square end. Each of these solutions to socket storage is unspecific as to socket size and none permits ready comparison of a bolt head with the socket holding stud to determine the correct socket size.

One object of the present invention is to provide for a socket holder which affords a convenient method of storing sockets.

Another object of the present invention is to provide for a socket holder which includes a template for comparing the fastener head to the socket to be employed.

A further object of the present invention is to provide for a socket holder which allows improved organization of sockets.

These and other objects will become apparent to those skilled in the art in light of the following disclosure and accompanying drawings.

BRIEF SUMMARY OF THE INVENTION

In accordance with the invention, generally stated, a socket holder is provided that comprises an elongated body with a surface that has projecting from it socket holding studs in graded standard or metric sizes to hold different sockets. The socket holding studs will generally be hexagonal in shape, since the working end of the socket usually has either a six or twelve sided recess. The body can be of various lengths to hold different numbers of sockets. This allows the user to utilize one large socket holder to hold all of the sockets or two shorter socket holders to hold large and small sockets. Alternatively, the sockets are grouped on a separate socket holder according to drive size, depth, and standard or metric size.

The present invention keeps a group of sockets sorted so that one can find the desired size quickly and easily. The sockets are lined up from smallest to largest, and the size of each socket is preferably stamped or embossed in or imprinted or labeled on the elongated surface next to the socket holding stud. This saves time and frustration since the user does not need to look through a pile of sockets to find the size he needs. Keeping sockets on the socket holder also makes it easy to see when one is missing. This prevents the user from leaving a job site and forgetting one or more sockets. Small models of the socket holder are carried easily in a toolbox, and larger models are mounted on a wall, shelf, toolbox, cabinet, and the like in a garage or work shop.

The socket holding studs provide a further advantage; the bolt head can be compared to the socket holding stud easily to identify the correct socket to be employed. This is much easier for the user, who would otherwise be compelled to compare the bolt with the recessed working end of the socket, which is more difficult to determine accurately. The present invention also prevents a user from losing or misplacing a socket since he can tell immediately when one of the sockets is missing.

Large raised numerals or Braille symbols or other tactilely readable indicia can be provided for persons who are sightless or whose sight is impaired. There are many tasks being performed well by visually impaired persons for which the socket holder will be a particular boon, because their tactile senses are frequently highly developed, and being able to compare the bolt head or nut with the studs will be easy, and the orderly arrangement of the sockets and ease of identification by means of the raised symbols will facilitate matters. A squatter version of each stud can be provided at each corresponding stud as the indicium, with or without numerical indicia, which will facilitate comparing the size of a bolt head or nut. The body of the socket holder preferably includes one or more recesses or chambers for holding wrench handles or extension pieces ancillary to the wrenches.

DETAILED DESCRIPTION OF THE INVENTION

Figure 1:
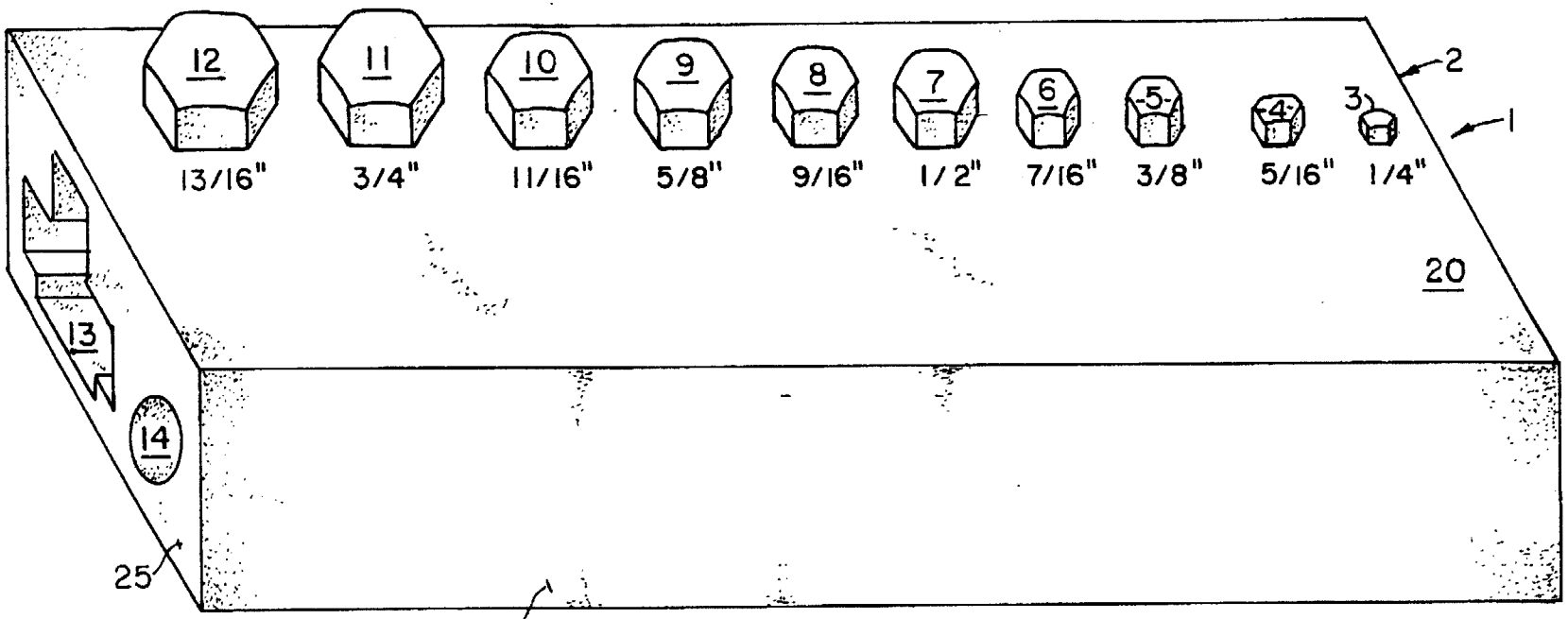
FIG. 1 is a perspective view of a socket holder of the present invention.
Figure 5:
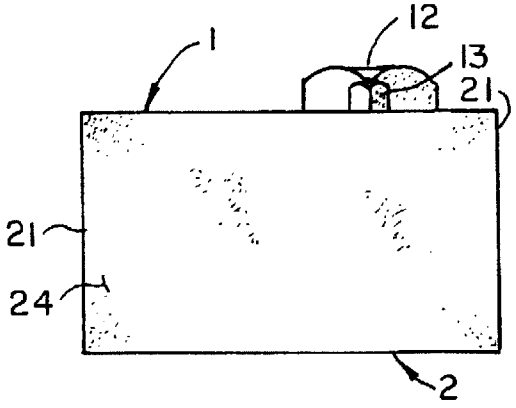
FIG. 5 is a rear elevational view of a socket holder of the present invention.

Referring to FIGS. 1–5 and FIG. 7 for one illustrative embodiment of socket holder of this invention, reference numeral 1 indicates an assembled socket holder. Socket holder 1 includes a body 2 and a plurality of socket holding studs 3–12. The body and socket holding studs are preferably molded of a tough, durable plastic such as polypropylene, in one piece, but may be made of other materials, and the studs can be threaded into internally threaded holes in the body.

The body 2 has a top surface 20 from which the socket holding studs project, sides 21, a bottom 23, and end walls 24 and 25. The end wall 24 is plane and uninterrupted. The end wall 25 is interrupted by two cavities, a ratchet driver cavity 13, and a drive bar cavity 14. The ratchet driver cavity 13 has a cruciform chamber extending from the surface 25 a distance to accommodate a head of a ratchet driver 18, and a continuing chamber to accommodate the handle of the ratchet driver 18. The drive bar cavity 14, is cylindrical, with a somewhat larger chamber extending from the end wall 25 a distance to accommodate an end of a drive bar 19, and a passage of smaller diameter to accommodate a shaft of the drive bar.

As can be seen the studs 3–12 are graduated in discrete sizes, in the illustrative embodiment, in increments of 1/16" from 1/4" to 13/16" from flat to flat. The studs are sized both heightwise and widthwise to engage the sockets closely enough so that the sockets will not be accidentally dislodged, but must be removed by lifting them straight off the studs. When they are formed of plastic, or otherwise formed integrally with the top 20, the studs will be given a slight draft so as to permit them to be pulled from the mold readily. In such a case, the root or base of the stud can be sized to engage the socket lightly frictionally to inhibit the accidental displacement of the sockets from the studs, as when the body 2 is set on the end surface 24 or one of the side surfaces 21, or suspended on a wall. For the latter purpose, a key hole slot of the usual sort can be provided, preferably on the bottom surface 23 near the end 25.

The studs 3–12 can also be magnetized, so that the sockets are held by magnetic attraction.

The studs can be provided with threaded shanks, and the body, with shank-receiving holes, either threaded, or if the plastic is sufficiently resilient, of a size to permit the threads of the shank to form threads in the wall defining the bore that receives the shank. If the studs are so provided, they can be removed, and compared with a bolt or nut to be backed off or backed out. It is not necessary to remove a stud to compare it with a nut or the head of a bolt to be installed, because that nut or bolt can simply be placed in immediate proximity to the stud.

As can readily be seen, although the indicium by each of the nuts in the illustrative embodiment is shown as varying from its neighbor in an increment of 1/16" from 1/4" to 13/16", the range can be greater, as for example, to 2", or smaller, and the increments can be greater or smaller, and the studs and their increments can be sized in metric units if the studs are to be used with metric sockets.

Figure 6:
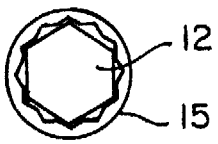
FIG. 6 is a cross sectional view of a twelve point socket mounted on a hexagonal stud of a socket holder of the present invention.
Figure 4:
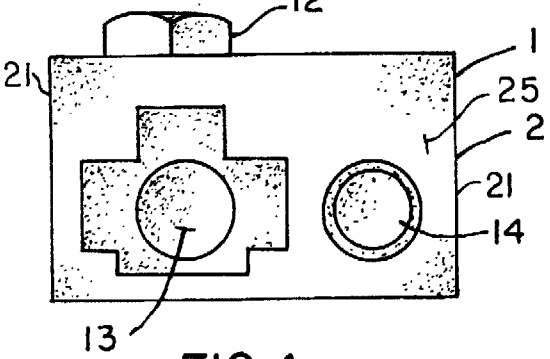
FIG. 4 is a front elevational view of a socket holder of the present invention.
Figure 2:
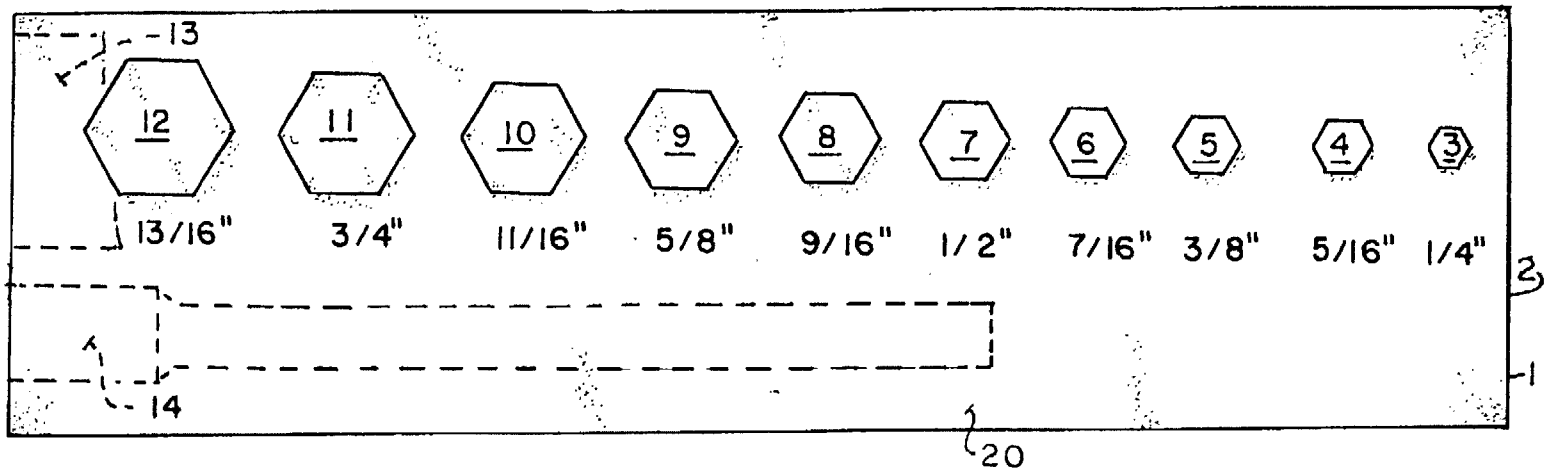
FIG. 2 is a top plan view of a socket holder of the present invention.
Figure 3:
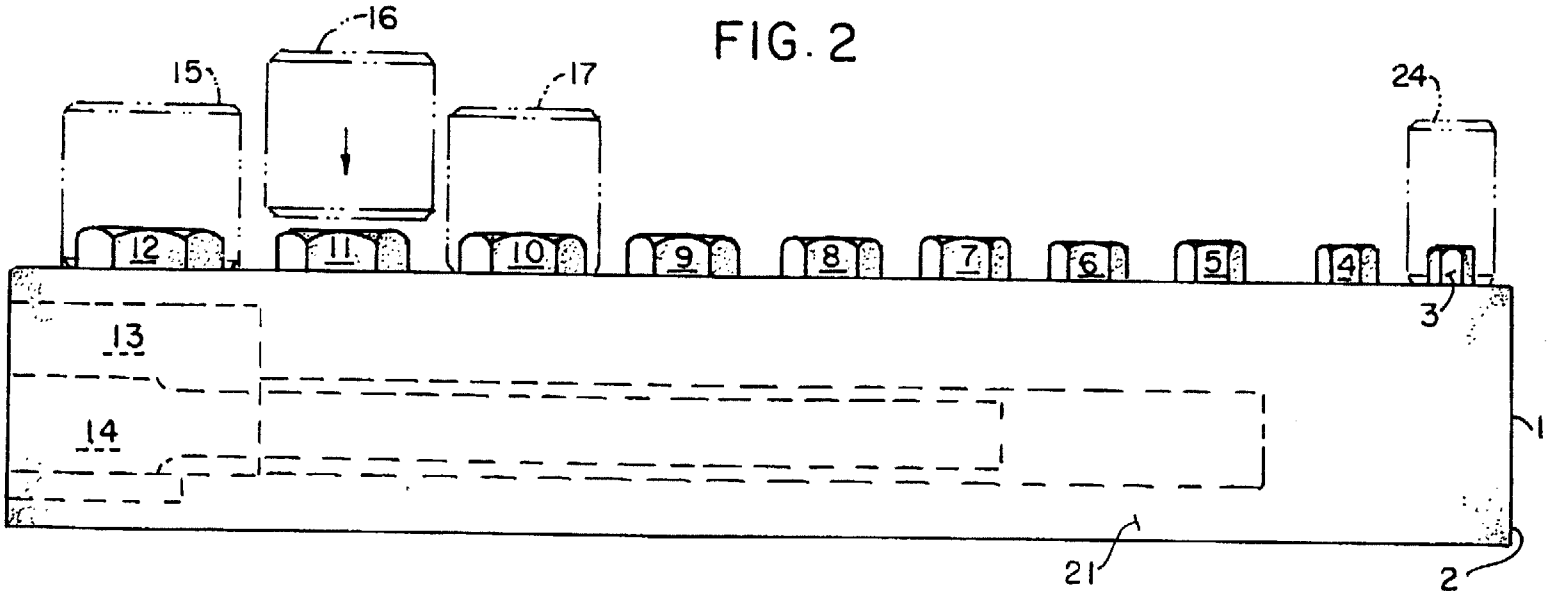
FIG. 3 is a side elevational view of a socket holder of the present invention.
Figure 7:
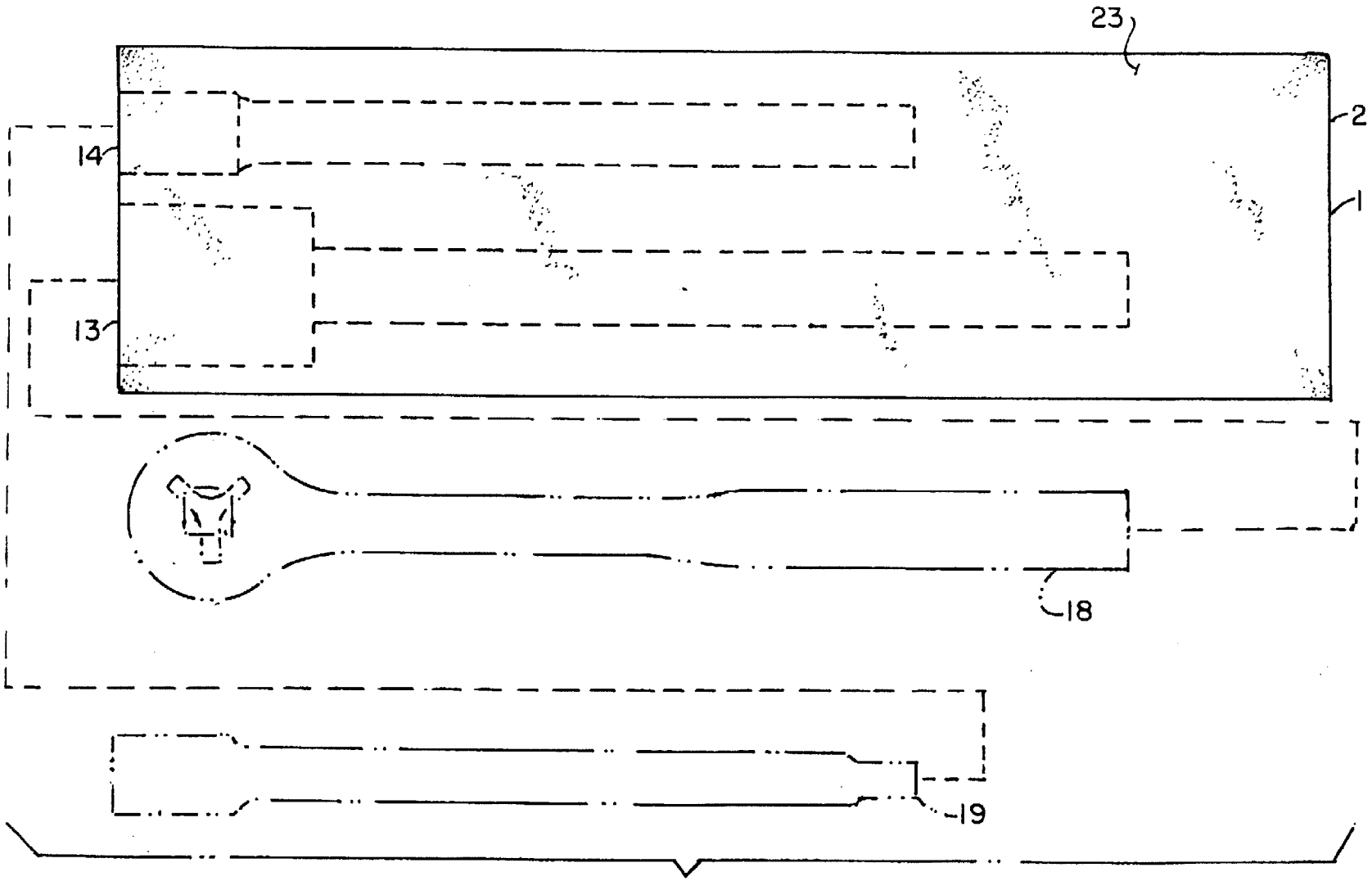
FIG. 7 is an exploded bottom plan view of a socket holder of the present invention, with wrench handle and extension receiving chambers shown in dotted lines and a wrench handle and extension shown in phantom lines.

In FIG. 6, the socket 15 is shown as a twelve point socket, to illustrate that either a twelve point or a six point socket will be accommodated by the hex stud 12. If different kinds of sockets are used, the shape of the studs can be modified to accommodate the particular shapes of the sockets, such as square or even asymmetrically shaped sockets for special purposes, but the studs should fit closely within and be shaped complementarily to the sockets in any event.

Numerous variations in the construction of the socket holder of this invention, within the scope of the appended claims, will be apparent to those skilled in the art in the light of the foregoing disclosure. Merely by way of example, two or more rows of studs can be provided, or separate bodies can be provided, with means such as dove tails to join them either side by side or lengthwise. The cavities can be modified in any desired way to accommodate different types of drivers, and additional cavities provided to accommodate various lengths of drive bar or drive bar extensions. The indicia can be in decimals or whole numbers, or any other form that is understood by the user. These are merely illustrative.

I claim:

1. A socket holder having a body including a bottom and a planar top surface, said top surface including a plurality of socket holding studs projecting from said surface, said socket holding studs being formed to receive closely a socket working end with a discrete size-on-size fit, said body being rectangular, with two long sides and two end walls, said body including a cavity extending lengthwise of said body and spaced from said bottom and top surface and side walls, and opening through one of said end walls, said cavity having a cruciform chamber at its open end to receive a ratchet driver.

2. The socket holder of claim 1 wherein the body includes a plurality of cavities, one of said cavities being formed to receive said ratchet driver and at least one of said cavities being formed to receive a drive bar.

* * * * *